US007667660B2

(12) United States Patent
Manasson et al.

(10) Patent No.: US 7,667,660 B2
(45) Date of Patent: Feb. 23, 2010

(54) SCANNING ANTENNA WITH BEAM-FORMING WAVEGUIDE STRUCTURE

(75) Inventors: Vladimir Manasson, Irvine, CA (US); Vladimir I. Litvinov, Aliso Viejo, CA (US); Lev Sadovnik, Irvine, CA (US); Mark Aretskin, Irvine, CA (US); Mikhail Felman, Tarzana, CA (US); Aramais Avakian, Pasadena, CA (US)

(73) Assignee: Sierra Nevada Corporation, Sparks, NV (US)

( * ) Notice: Subject to any disclaimer, the term of this patent is extended or adjusted under 35 U.S.C. 154(b) by 135 days.

(21) Appl. No.: 12/056,132

(22) Filed: Mar. 26, 2008

(65) Prior Publication Data

US 2009/0243950 A1 Oct. 1, 2009

(51) Int. Cl.
*H01Q 13/00* (2006.01)

(52) U.S. Cl. ..... 343/785; 343/781 R; 343/781 P

(58) Field of Classification Search ..... 343/785, 343/772, 776, 781 R, 781 P, 782, 783; 333/248
See application file for complete search history.

(56) References Cited

U.S. PATENT DOCUMENTS

| | | | | |
|---|---|---|---|---|
| 5,572,228 | A | 11/1996 | Manasson et al. | |
| 5,815,124 | A | 9/1998 | Manasson et al. | |
| 5,886,670 | A | 3/1999 | Manasson et al. | |
| 6,211,836 | B1 | 4/2001 | Manasson et al. | |
| 6,750,827 | B2 | 6/2004 | Manasson et al. | |
| 7,151,499 | B2 * | 12/2006 | Avakian et al. | 343/785 |
| 7,333,690 | B1 * | 2/2008 | Peale et al. | 385/30 |
| 7,456,787 | B2 * | 11/2008 | Manasson et al. | 342/375 |
| 7,532,171 | B2 * | 5/2009 | Chandler | 343/731 |

FOREIGN PATENT DOCUMENTS

EP 1717903 11/2006

OTHER PUBLICATIONS

International Search Report on corresponding PCT application (PCT/US2009/036219) from International Searching Authority (KIPO) dated Jun. 29, 2009.

(Continued)

*Primary Examiner*—Hoang V Nguyen
(74) *Attorney, Agent, or Firm*—Klein, O'Neill & Singh, LLP

(57) ABSTRACT

A scanning antenna with an antenna element having an evanescent coupling portion includes a waveguide assembly including a transmission line, adjacent the coupling portion, through which an electromagnetic signal is transmitted, permitting evanescent coupling of the signal between the transmission line and the antenna element. First and second conductive waveguide plates, on opposite sides of the transmission line, define planes that are substantially parallel to the axis of the transmission line, each plate extending distally from a proximal end adjacent the antenna element, whereby the propagated signal forms a beam that is confined to the space between the plates and thus limited to a plane that is parallel to the planes defined by the plates. The signal coupled between the transmission line and the antenna element is preferably polarized so that its electric field component is in a plane parallel to the planes defined by the plates.

37 Claims, 4 Drawing Sheets

OTHER PUBLICATIONS

Written Opinion on corresponding PCT application (PCT/US2009/036219) from International Searching Authority (KIPO) dated Jun. 29, 2009.

Manasson et al.; "Monolithic Electronically Controlled Millimeter-Wave Beam-Steering Antenna"; Digest of Papers of 1998 Topical Meeting on Silicon Monolithic Integrated Circuits in RF Systems, Sep. 17-18, 1998, pp. 215-217.

Manasson et al.; "MMW Scanning Antenna"; *IEEE Aerospace and Electronic Systems Magazine*, vol. 11, No. 10, pp. 29-33, Oct. 1996.

* cited by examiner

SCANNING ANTENNA WITH BEAM-FORMING WAVEGUIDE STRUCTURE

CROSS-REFERENCE TO RELATED APPLICATION

Not Applicable

FEDERALLY-SPONSORED RESEARCH OR DEVELOPMENT

Not Applicable

BACKGROUND

The present disclosure relates generally to the field of scanning antennas or beam-steering antennas, of the type employed in such applications as radar and communications. More specifically, this disclosure relates to a scanning or beam-steering antennas in which electromagnetic radiation is evanescently coupled between a dielectric transmission line and an antenna element having a coupling geometry, and which steer electromagnetic radiation in directions determined by the coupling geometry.

Scanning or beam-steering antennas, particularly dielectric waveguide antennas, are used to send and receive steerable millimeter wave electromagnetic beams in various types of communication applications and in radar devices, such as collision avoidance radars. In such antennas, an antenna element includes an evanescent coupling portion having a selectively variable coupling geometry. A transmission line, such as a dielectric waveguide, is disposed closely adjacent to the coupling portion so as to permit evanescent coupling of an electromagnetic signal between the transmission line and the antenna elements, whereby electromagnetic radiation is transmitted or received by the antenna. The shape and direction of the transmitted or received beam are determined by the coupling geometry of the coupling portion. By controllably varying the coupling geometry, the shape and direction of the transmitted/received beam may be correspondingly varied.

The coupling portion may be a portion of the antenna element formed as controllably variable diffraction grating, or it may be a coupling edge of the antenna element having an electrically or electromechanically variable coupling geometry. A controllably variable diffraction grating that provides a beam-steering or scanning function may be provided, for example, on the surface of a rotating cylinder or drum as disclosed in such exemplary documents as U.S. Pat. Nos. 5,571,228; 6,211,836; and 6,750,827, the disclosures of which are expressly incorporated herein by reference. An example of an antenna element having a coupling edge with a controllably variable geometry is disclosed in U.S. Pat. No. 7,151,499, the entire disclosure of which is expressly incorporated herein by reference. In this last-mentioned document, the geometry of the coupling edge is determined by a pattern of electrical connections that is selected for the edge features of the coupling edge. This pattern of electrical connections may be controllably selected and varied by an array switches that selectively connect the edge features. Any of several types of switches integrated into the structure of the antenna element may be used for this purpose, such as, for example, semiconductor plasma switches. A specific example of an evanescent coupling antenna in which the geometry of the coupling edge is controllably varied by semiconductor plasma switches is disclosed and claimed in the commonly-assigned, co-pending application Ser. No. 11/939,385; filed Nov. 13, 2007, the disclosure of which is incorporated herein by reference in its entirety.

While the prior art, as exemplified by the above-mentioned documents, provides acceptable performance in terms of beam-shaping, beam-steering and scanning, improvements are still sought in the functionality of scanning antennas. In particular, improvements in scanning accuracy and controllability in a single selected plane (e.g., the horizontal plane, or azimuth) would be an advantageous advancement in the state of the art.

SUMMARY OF THE DISCLOSURE

Broadly, the present disclosure, in one aspect, relates to a scanning antenna comprising an antenna element having an evanescent coupling portion with a selectively variable coupling geometry; and a waveguide assembly, wherein the waveguide assembly comprises (a) a transmission line through which an electromagnetic signal is transmitted, wherein the transmission line defines an axis, and wherein the transmission line is located adjacent the evanescent coupling portion so as to permit evanescent coupling of the electromagnetic signal between the transmission line and the antenna element; and (b) first and second substantially parallel conductive waveguide plates disposed on opposite sides of the transmission line, each of the plates defining a plane that is substantially parallel to the axis defined by the transmission line, each of the plates having a proximal end adjacent the antenna element, and a distal end remote from the antenna element, whereby the electromagnetic signal propagated as a result of the evanescent coupling forms a beam that is confined to the space defined between the plates so as to substantially limit the beam to a plane that is parallel to the planes defined by the plates. To prevent signal leakage between the plates and the antenna element, the signal coupled between the transmission line and the antenna element is preferably polarized so that its electric field component is in a plane parallel to the planes defined by the plates.

In accordance with another aspect, this disclosure relates to a waveguide assembly for a scanning antenna for the transmission and/or reception of an electromagnetic signal, wherein the antenna including an antenna element with an evanescent coupling portion. In accordance with this aspect, the waveguide assembly comprises (a) a transmission line through which an electromagnetic signal is transmitted, wherein the transmission line defines an axis, and wherein the transmission line is located adjacent the evanescent coupling portion of the antenna element so as to permit evanescent coupling of an electromagnetic signal between the transmission line and the antenna element; and (b) first and second substantially parallel conductive waveguide plates disposed on opposite sides of the transmission line, each of the plates defining a plane that is substantially parallel to the axis defined by the transmission line; whereby the electromagnetic signal coupled between the transmission line and the antenna element propagates as a beam that is substantially confined to a space defined between the first and second plates, whereby the beam is in a plane that is substantially parallel to the planes defined by the first and second plates.

In accordance with this second aspect, in a preferred embodiment thereof, if the electromagnetic signal has a propagation wavelength $\lambda$, each of the plates has a proximal end spaced from the antenna element by a gap of less than $\lambda/2$ in width, and the plates are separated by a distance that is less than $\lambda$ and greater than $\lambda/2$. Furthermore, as in the first aspect, the signal coupled between the transmission line and the antenna element is preferably polarized so that its electric field component is in a plane parallel to the planes defined by the plates.

DETAILED DESCRIPTION

Figure 1:
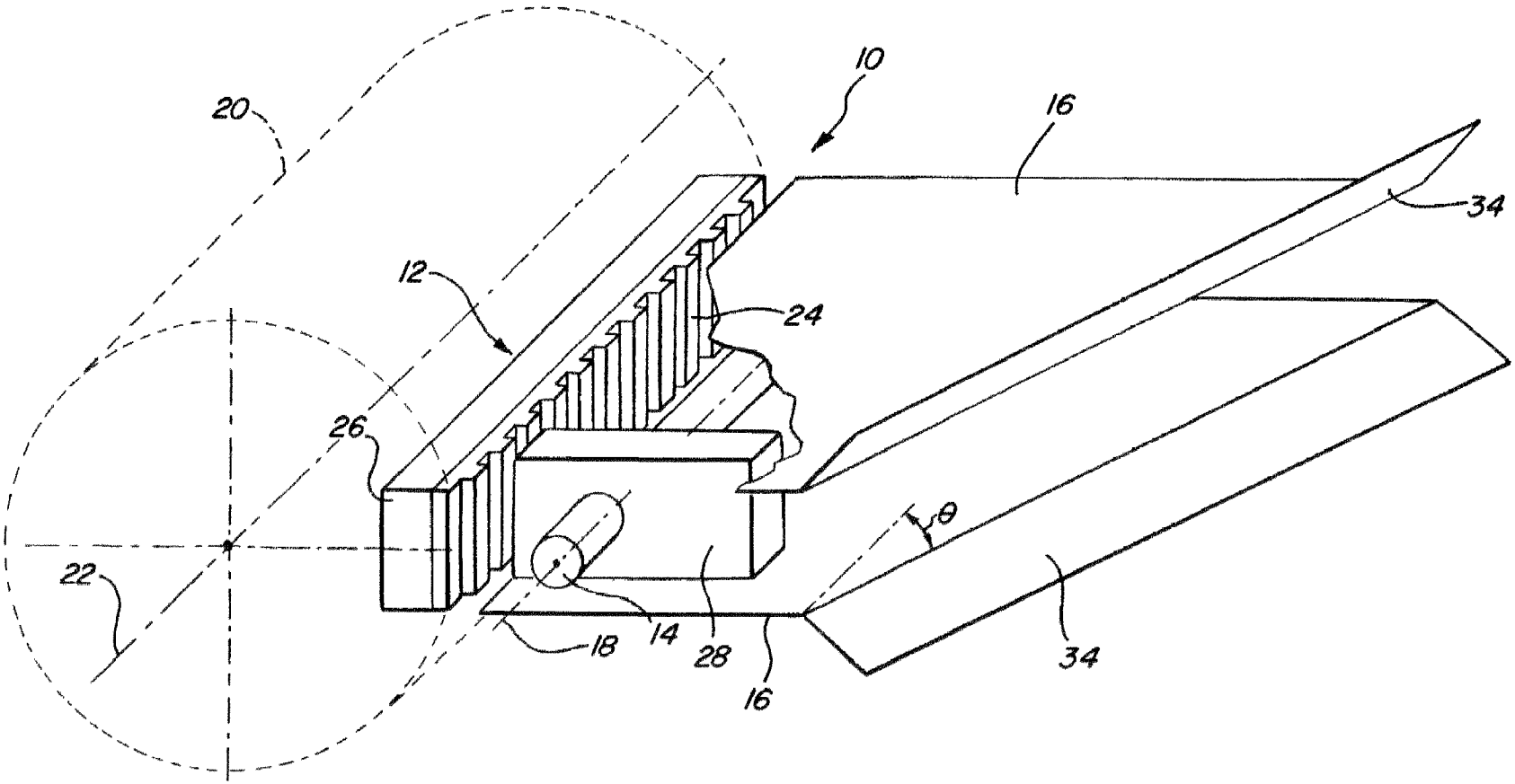
FIG. 1 is a semi-schematic perspective view of a first embodiment of a scanning antenna in accordance with the present disclosure.
Figure 2:
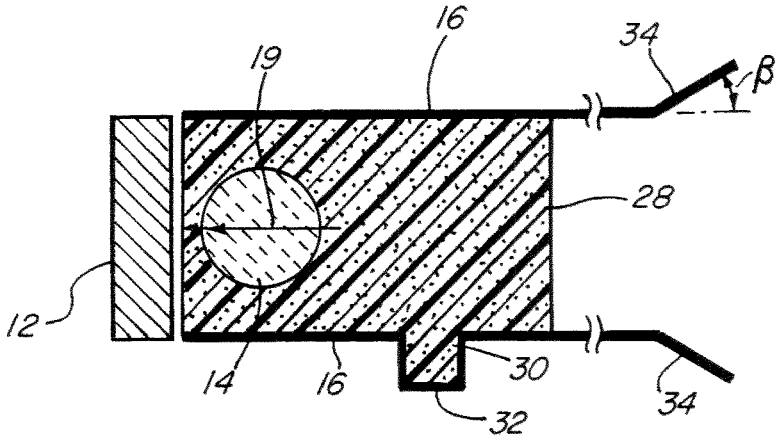
FIG. 2 is a semi-schematic cross-sectional view of the antenna of FIG. 1.

Referring first to FIGS. 1 and 2, a scanning antenna 10, in accordance with a first embodiment of the present invention includes an antenna element 12 and a waveguide assembly comprising a transmission line 14 and a pair of substantially parallel conductive waveguide plates 16. The transmission line 14 is preferably an elongate, rod-shaped dielectric waveguide element with a circular cross-section, as shown, and it defines an axis 18. Dielectric waveguide transmission lines with other configurations, such as rectangular or square in cross-section, may also be employed. To prevent leakage of electromagnetic radiation via gaps between the plates 16 and the antenna element 12, the polarization of the electromagnetic waves supported by the waveguide assembly 14, 16 is advantageously such that the electric field component is preferably in a plane that is parallel to the planes defined by the plates 16, as indicated by the arrow 19 in FIG. 2. Any gaps between the plates 16 and the antenna element 12 should be less than one-half the wavelength of the transmitted/received radiation in the propagation medium (e.g., air).

The antenna element 12, in this embodiment, includes a drum or cylinder 20 that is rotated by conventional electromechanical means (not shown) around a rotational axis 22 that may be, but is not necessarily, parallel to the axis 18 of the transmission line 14. Indeed, it may be advantageous for the rotational axis 20 to be skewed relative to the transmission line axis 18, as taught, for example, in above-mentioned U.S. Pat. No. 5,572,228.

The drum or cylinder 20 may advantageously be any of the types disclosed in detail in, for example, the above-mentioned U.S. Pat. Nos. 5,572,228; 6,211,836; and 6,750,827. Briefly, the drum or cylinder 20 has an evanescent coupling portion located with respect to the transmission line 14 so as to permit evanescent coupling of an electromagnetic signal between the coupling portion and the transmission line 14. The evanescent coupling portion has a selectively variable coupling geometry, which advantageously may take the form of a conductive metal diffraction grating 24 having a period $\Lambda$ that varies in a known manner along the circumference of the drum or cylinder 20. Alternatively, several discrete diffraction gratings 24, each with a different period $\Lambda$, may be disposed at spaced intervals around the circumference of the drum or cylinder 20. As taught, for example, in the aforementioned U.S. Pat. No. 5,572,228, the angular direction of the transmitted or received beam relative to the transmission line 14 is determined by the value of $\Lambda$ in a known way. In FIG. 1, for example, the illustrated diffraction grating 24 may either be a part of a single, variable-period diffraction grating (the remainder of which is not shown), or one of several discrete diffraction gratings (the others not being shown), each with a distinct period $\Lambda$. In either case, the diffraction grating 24 is provided on the outer circumferential surface of the drum or cylinder 20. Specifically, the grating 24 is formed on or fixed to the outer surface of a rigid substrate 26, which may be an integral part of the drum or cylinder 20, or it may be formed on the outer surface of a central core (not shown).

The waveguide plates 16 are disposed on opposite sides of the transmission line 14, each of the plates 16 defining a plane that is substantially parallel to the axis 18 defined by the transmission line 14. Each of the plates 16 has a proximal end adjacent the antenna element 12, and a distal end remote from the antenna element 12. The plates 16 are separated by a separation distance d that is less than the wavelength $\lambda$ of the electromagnetic signal in the propagation medium (e.g., air), and greater than $\lambda/2$ to allow the electromagnetic wave with the above-described polarization to propagate between the plates 16. The arrangement of the transmission line 14, the antenna element 12 and the waveguide plates 16 assures that the electromagnetic signal coupled between the transmission line 14 and the antenna element 12 is confined to the space between the waveguide plates 16, thereby effectively limiting the signal beam propagated as a result of the evanescent coupling to two dimensions, i.e., a single selected plane parallel to the planes defined by the plates 16. Thus, beam-shaping or steering is substantially limited to that selected plane, which may, for example, be the azimuth plane.

As also shown in FIGS. 1 and 2, the transmission line 14 is advantageously supported by at least two support elements 28, only one of which is shown in the drawings. The support elements 28 may likewise be used to provide structural support for the first and second waveguide plates 16 that are affixed to the top and bottom, respectively, of each support element 28. The support elements 28 are preferably formed of a material having a low dielectric pemiittivity $\in$ (i.e., $\in \approx 1$), such as, for example, polyethylene foam. While the plates 16 may be fixed to the support elements 28 by a suitable adhesive, it is possible that any adhesive will affect the evanescent coupling between the transmission line 14 and the antenna element 12, and/or the waveguide function provided by the plates 16. To avoid or minimize possible performance degradation as a result of the use of an adhesive, it is preferred to fix the plates 16 to the support elements 28 by purely mechanical means. For example, as shown in FIG. 2, a tongue-and-groove arrangement can be provided, comprising a protrusion or tongue 30 on at least one side of each support element 28, that is received in a corresponding groove or notch 32 formed in the adjacent plate or plates 16. Although the tongue-and-groove arrangement is shown on only one side of a support element 28 in FIG. 2, it is understood that such an arrangement can be provided on both the top and bottom of the support elements 28.

The two plates 16 constitute a planar hollow waveguide for the antenna beam. Due to the antenna scan, the direction of propagation of the wave supported by this planar waveguide is variable. Some of these directions are not desirable. For example the direction that is close to the normal to the transmission line axis 18 is obtained when so-called "Bragg conditions" occur. Such conditions may create strong back-reflection and degradation of the antenna matching with transceiver. Therefore, for some applications, it is advantageous to have a scan sector that does not include the direction of wave propagation that is perpendicular to the transmission line axis 18. In such cases, the central direction of the scan is also not perpendicular to the transmission line axis 18, and thus the scan will be asymmetric with reference to the distal edge of the planar waveguide provided by the plates 16. To make this scan symmetric, a design such as shown in FIG. 1 is employed, in which the distal end of each of the plates 16 may define an angle θ with the axis 18 of the transmission line 14.

As shown in FIGS. 1 and 2, the distal end of each of the plates 16 may be bent or turned outwardly from the plane of the plates at an angle β relative to that plane, thereby forming a pair of horn elements 34 for matching the impedance of the parallel plate waveguide formed by the plates 16 with the impedance of free space.

Figure 3:
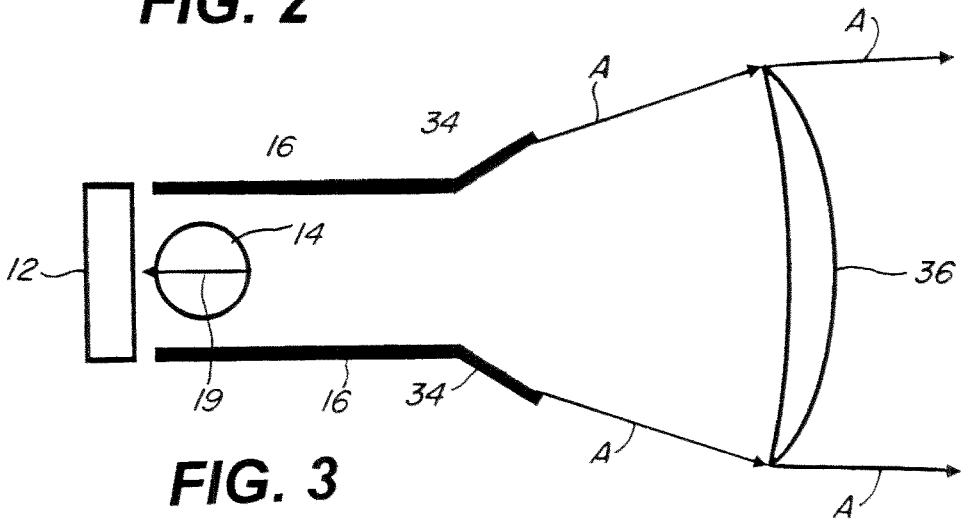
FIG. 3 is a semi-schematic view of a first modification of the antenna of FIG. 1.

FIG. 3 shows a modified form of the antenna of FIGS. 1 and 2. In this modification, a refractive element or lens 36 is placed distally from the horn elements 34 for the purpose of collimating or focusing the propagated beam A. The lens 36 is made of a suitable material for refracting microwaves, particularly millimeter waves. Among the suitable materials for the lens 36 are polystyrene, PTFE, and polyethylene. A particular material that may advantageously be used is the cross-linked polystyrene marketed under the trademark Rexolite® by C-Lec Plastics, Inc., of Philadelphia, Pa. (www.rexolite-.com).

Figure 4:
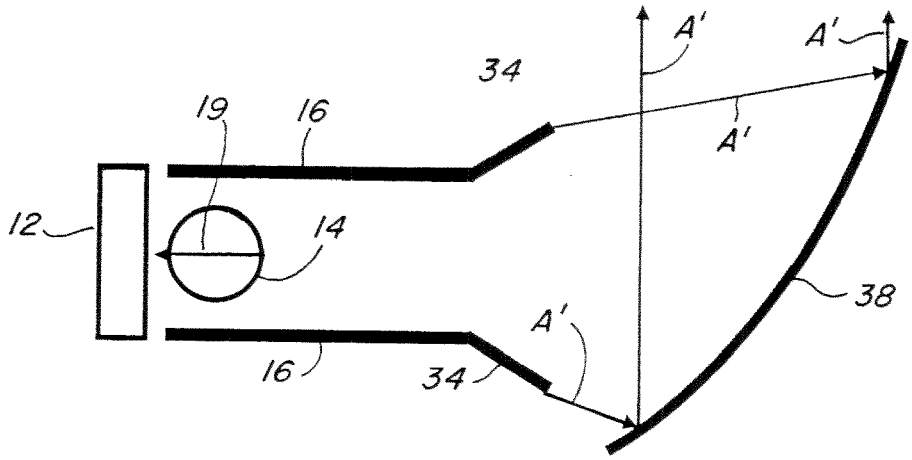
FIG. 4 is a semi-schematic view of a second modification of the antenna of FIG. 1.

FIG. 4 shows another modified form of the antenna of FIGS. 1 and 2. In this modification, a reflecting element 38, such as a parabolic mirror, made of a suitable metal, is placed distally from the horn elements 34, for re-directing the propagated beam A' out of the original plane of propagation. Thus, for example, a beam that is initially propagated substantially in the azimuth plane may be re-directed to the elevational plane.

Figure 5:
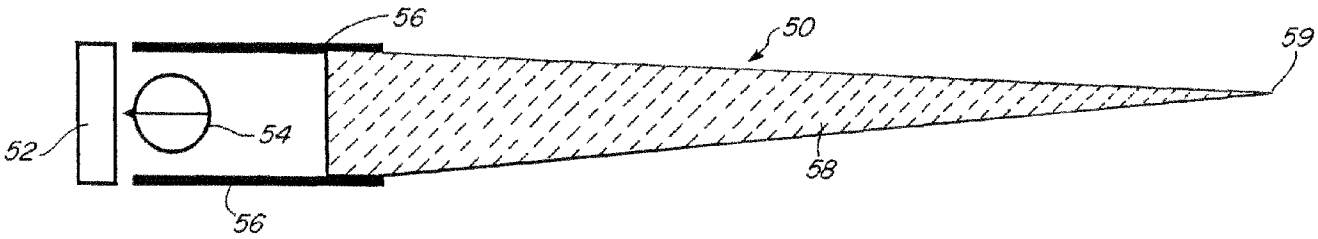
FIG. 5 is a semi-schematic view of a second embodiment of a scanning antenna in accordance with the present disclosure.
Figure 6:
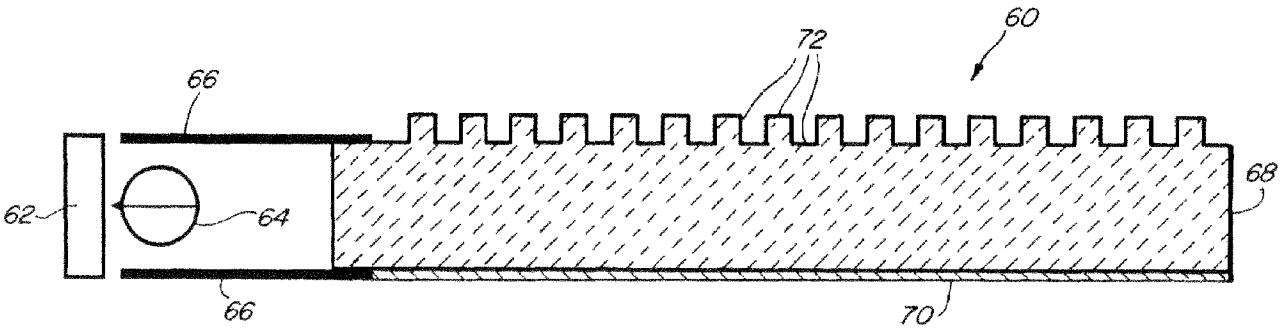
FIG. 6 is a semi-schematic view of a third embodiment of a scanning antenna in accordance with the present disclosure.
Figure 7:
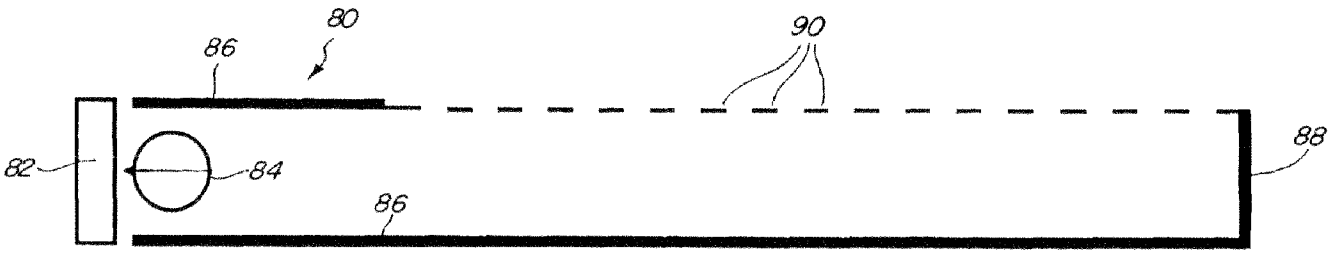
FIG. 7 is a semi-schematic view of a fourth embodiment of a scanning antenna in accordance with the present disclosure.

FIGS. 5, 6, and 7 illustrate scanning antennas in accordance with second, third, and fourth embodiment, respectively. All of these embodiments employ a "leaky" planar waveguide element, as will be described below.

As shown in FIG. 5, a scanning antenna 50 comprises an antenna element 52, a transmission line 54, and a pair of conductive waveguide plates 56, as described above with respect to the embodiment of FIGS. 1 and 2. Instead of the horn elements 34 (FIGS. 1 and 2), however, the antenna 50 includes a "leaky" planar dielectric waveguide element 58 extending distally from the plates 56. The dielectric waveguide element 58 is substantially wedge-shaped or triangular in cross-section, forming a linear edge 59 at its distal end. The dielectric waveguide element 58 provides a degree of beam collimation or focusing, much like the lens 36 in the above-described embodiment of FIG. 3, but it offers a lower profile in the vertical dimension (i.e., perpendicular to the planes defined by the plates 16).

FIG. 6 shows a scanning antenna 60 that comprises an antenna element 62, a transmission line 64, and a pair of conductive waveguide plates 66, as described above with respect to the embodiment of FIGS. 1 and 2. Like the above-described embodiment of FIG. 5, the antenna 60 has a "leaky" planar dielectric waveguide element 68 instead of horn elements at the distal ends of the plates 66. The dielectric waveguide element 68 extends distally from the waveguide plates 66, and it has a first major surface in intimate contact with a conductive ground plate 70, and a second major surface formed as a diffraction grating 72.

FIG. 7 shows a scanning antenna 80 that comprises an antenna element 82, a transmission line 84, and a pair of conductive waveguide plates 86, as described above with respect to the embodiment of FIGS. 1 and 2. Like the above-described embodiments of FIGS. 5 and 6, the antenna 80 has a "leaky" planar waveguide element 88 extending distally from the waveguide plates 86. In the FIG. 7 embodiment, however, the leaky waveguide element 88 is formed of a conductive metal and it has a major surface formed as a slot-array diffraction grating 90.

Figure 8:
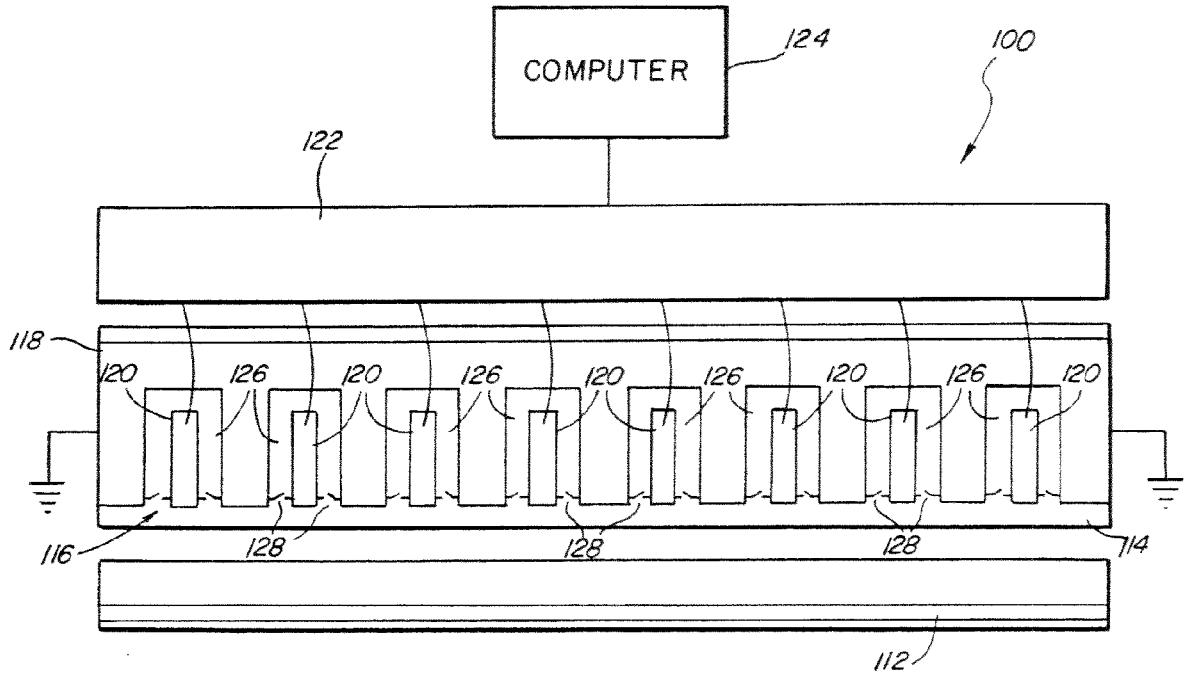
FIG. 8 is a semi-schematic plan view of an antenna element and transmission line employed in a scanning antenna in accordance with a fifth embodiment of the present disclosure.
Figure 9:
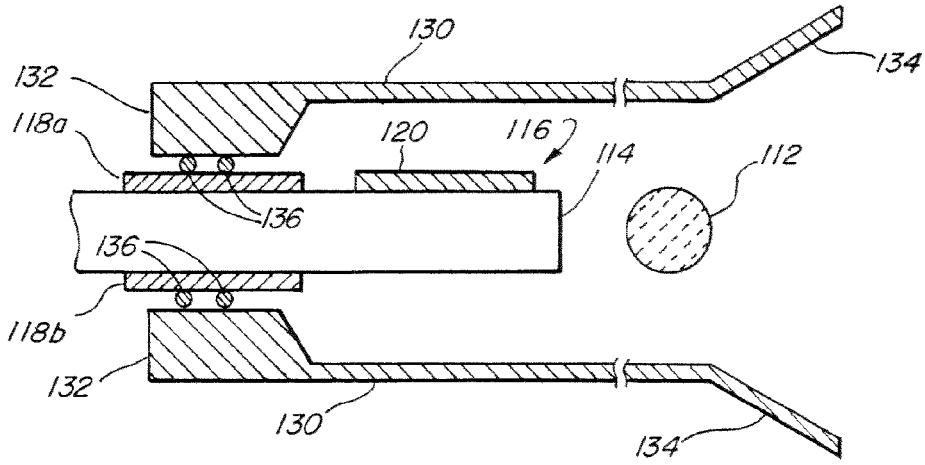
FIG. 9 is a semi-schematic cross-sectional view of a scanning antenna in accordance with a fifth embodiment of the present disclosure.

FIGS. 8 and 9 illustrate a scanning antenna in accordance with a fifth embodiment of the present disclosure. As described in detail below, the embodiment of FIGS. 8 and 9 differs from the previously-described embodiments principally in that the antenna element comprises a monolithic array of coupling edge elements, as described in detail in the commonly-assigned, co-pending application Ser. No. 11/956,229, filed Dec. 13, 2007, the disclosure of which is incorporated herein in its entirety. For ease of reference a brief description of the transmission line and antenna element of the antenna disclosed in application Ser. No. 11/956,229 is set out below. As will be understood from the ensuing description, the antenna element of the aforesaid antenna has an evanescent coupling edge with a coupling geometry determined by a pattern of electrical connections that is selected for the edge features of the coupling edge. This pattern of electrical connections may be controllably selected and varied by an array switches that selectively connect the edge features.

As shown in FIGS. 8 and 9, an electronically-controlled monolithic array antenna 100 comprises a transmission line 112 in the form of a narrow, elongate dielectric rod, and a substrate 114 on which is disposed a conductive metal antenna element that defines an evanescent coupling edge 116, as will be described in detail below, that is aligned generally parallel to the transmission line 112. The antenna element comprises a conductive metal ground plate 118 and a plurality of conductive metal edge elements 120 arranged in a substantially linear array along or near the front edge of the substrate 114 so as to form the coupling edge 116. The alignment of the coupling edge 116 and the transmission line 112, and their proximity to each other, allow the evanescent coupling of electro magnetic radiation between the transmission line 112 and the coupling edge 116, as is well-known in the art.

The substrate 114 may be a dielectric material, such as quartz, sapphire, ceramic, a suitable plastic, or a polymeric composite. Alternatively, the substrate 114 may be a semiconductor, such as silicon, gallium arsenide, gallium phosphide, germanium, gallium nitride, indium phosphide, gallium aluminum arsenide, or SOI (silicon-on-insulator). The antenna element (comprising the ground plate 118 and the edge elements 120) may be formed on the substrate 114 by any suitable conventional method, such as electrodeposition or electroplating followed by photolithography (masking and etching). If the substrate 114 is made of a semiconductor, it may be advantageous to apply a passivation layer (not shown) on the surface of the substrate before the antenna element 118, 120 is formed.

As shown in FIG. 8, in the antenna 100 the ground plate 118 is connected to ground or is maintained at a suitable, fixed reference potential. The edge elements 120 are individually connected to a control signal source 122, which may be a controllable current source. The control signal source 122 may be under the control of an appropriately programmed computer or microprocessor 124 in accordance with an algorithm that may be readily derived for any particular application by a programmer of ordinary skill in the art.

Each of the edge elements 120 is physically and electrically isolated from the ground plate 118 by an insulative isolation gap 126. Thus, each of the edge elements 120 is in the form of a conductive "island" surrounded on three sides by the ground plate 118, with the fourth side facing the transmission line 112 and forming a part of the coupling edge 116.

As shown in FIG. 9, the ground plate 118 may be a multi-element ground plate, comprising a first ground plate element 118*a* on the upper surface of the substrate 114, and a second ground plate element 118*b* on the lower surface of the substrate 114. In this context, the upper surface is the surface on which the edge elements 120 are disposed, and the lower surface is the opposite surface.

The coupling geometry of the coupling edge 116 is controllably varied by a plurality of switches 128, each of which may be selectively actuated to electrically connect one of the edge elements 120 to the ground plate 118 across one of the insulative isolation gaps 126. A switch 128 is disposed across each of the gaps 126 near the coupling edge 116, so that each of the edge elements 120 is connectable to the ground plate 118 by two beam-directing switches 128: one switch across each of the gaps 126 on either side of the edge element 120.

The switches 128 may be any suitable type of micro-miniature snitch that can incorporated on or in the substrate 114. For example, the switches 128 can be semiconductor switches (e.g., PIN diodes, bipolar transistors, MOSFETs, or heterojunction bipolar transistors), MEMS switches, piezoelectric switches, capacitive switches (such as varactors), lumped IC switches, ferro-electric switches, photoconductive switches, electromagnetic switches, gas plasma switches, and semiconductor plasma switches.

As shown in FIG. 8, each of the switches 128 is located near the open end of its associated gap 126; that is, close to the coupling edge 116. The gaps 126 function as slotlines through which electromagnetic radiation of a selected effective wavelength (in the slotline medium) $\lambda$ propagates. If the length of the gaps 126 is $\lambda/4$, the phase angle $\phi$ of the output wave at the coupling edge 116 is $2\pi$ radians at the outlet (open end) of any gap 126 for which the associated switch 128 is open. For any gap 26 for which the associated switch is closed (effectively grounding the edge element 120), the phase angle $\phi$ of the output wave at the coupling edge is $\pi$ radians. Typically, in operation, the switches 128 will be selectively opened and closed to create a diffraction grating with a period P=N+M, comprising N gaps or slotlines 126 with open switches 128, followed by M gaps or slotlines 126 with closed switches 128. Viewed another way, the grating period P will comprise N slotlines providing a coupling edge phase angle $\phi$ of $2\pi$ radians, followed by M slotlines providing a coupling edge phase angle $\phi$ of $\pi$ radians. Thus, the grating period P will be the distance between the first of the N "open" slotlines and the last of the M "closed" slotlines. The resultant beam angle $\alpha$ will thereby be given by the formula:

$$\sin \alpha = \beta/k - \lambda/Pd,$$

where $\beta$ is the wave propagation constant in the transmission line 112, k is the wave vector in a vacuum, $\lambda$ is the effective wavelength of the electromagnetic radiation propagating through the medium of the slotlines 126, and d is the spacing between adjacent antenna edge elements 120.

It will be seen from the foregoing formula that by selectively opening and closing the switches 128, the grating period P can be controllably varied, thereby controllably changing the beam angle $\alpha$ of the electromagnetic radiation coupled between the transmission line 112 and the antenna element 118, 120.

As shown in FIG. 9, a pair of parallel conductive metal waveguide plates 130 is provided, one adjacent either side of the substrate 114. Each of the waveguide plates 130 extends from a proximal support portion 132, adjacent to one of the ground plate elements 118*a*, 118*b*, to a distal portion that is distant from the coupling edge 116 and that may advantageously terminate in an angled horn element 134, as previously described. The proximal support portion of each of the plates 130 may be electrically and mechanically connected to an adjacent one of the ground plate elements 118*a*, 118*b* by means of conductive connecting elements 136. Alternatively, instead of the horn elements 134, the antenna 100 may include one of the leaky planar waveguide elements described above and illustrated in FIGS. 5, 6, and 7. Also, as described above, the transmission line 112 may be supported in support blocks (not shown) that may also provide structural support for the plates 130, as described above in connection with the embodiment of FIGS. 1 and 2. The function of the antenna 100 is substantially the same as that described above for the embodiment of FIGS. 1 and 2.

What is claimed is:

1. A scanning antenna, comprising:

an antenna element having an evanescent coupling portion with a selectively variable coupling geometry; and a waveguide assembly, comprising:

a transmission line through which an electromagnetic signal is transmitted, wherein the transmission line defines an axis, and wherein the transmission line is located adjacent the evanescent coupling portion of the antenna element so as to permit evanescent coupling of an electromagnetic signal between the transmission line and the antenna element; and first and second substantially parallel conductive waveguide plates disposed on opposite sides of the transmission line, each of the plates defining a plane that is substantially parallel to the axis defined by the transmission line each of the plates having a proximal end adjacent the antenna element, and a distal end remote from the antenna element;

whereby the electromagnetic signal coupled between the transmission line and the antenna element propagates as a beam that is substantially confined to a space defined between the first and second plates, whereby the beam is in a plane that is substantially parallel to the planes defined by the first and second plates.

2. The scanning antenna of claim 1, wherein the electric field component of the beam is polarized in a plane parallel to the planes defined by the plates.

3. The scanning antenna of claim 1, wherein the antenna element comprises a diffraction grating.

4. The scanning antenna of claim 3, wherein the diffraction grating has a controllably variable grating period.

5. The scanning antenna of claim 4, wherein the antenna element comprises a rotating drum having a surface defining the diffraction grating.

6. The scanning antenna of claim 5, wherein the controllably variable grating period is provided by a plurality of diffraction gratings of different grating periods formed on the surface of the drum.

7. The scanning antenna of claim 1, wherein the antenna element comprises:

a conductive metal ground plate;

an array of conductive metal edge elements defining the coupling edge, each of the edge elements being electrically connected to a control signal source, and each of the edge elements being electrically isolated from the ground plate by an insulative isolation gap; and a plurality of switches, each of which is selectively operable in response to the control signal to electrically connect selected edge elements to the ground plate across the insulative isolation gap so as to provide a selectively variable electromagnetic coupling geometry of the coupling edge.

8. The scanning antenna of claim 1, wherein the distal end of each of the plates is angled outwardly from the plane of the associated plate, whereby the distal ends of the plates form a horn element.

9. The scanning antenna of claim 1, wherein the waveguide assembly further comprises a leaky planar waveguide element disposed between the plates and extending distally from the distal ends of the plates.

10. The scanning antenna of claim 9, wherein the leaky planar waveguide element comprises a dielectric waveguide element.

11. The scanning antenna of claim 10, wherein the dielectric waveguide element has a distal end forming a linear edge that is substantially parallel with the axis defined by the transmission line.

12. The scanning antenna of claim 10, wherein the dielectric waveguide element includes a surface configured as a fixed diffraction grating.

13. The scanning antenna of claim 9, wherein the leaky waveguide element comprises a conductive metal waveguide element that defines a fixed diffraction grating.

14. The scanning antenna of claim 9, wherein the leaky planar waveguide element defines a fixed diffraction grating.

15. The scanning antenna of claim 14, wherein the leaky planar waveguide element comprises a dielectric waveguide element.

16. The scanning antenna of claim 14, wherein the leaky planar waveguide element comprises a conductive metal waveguide element.

17. The scanning antenna of claim 1, wherein the electromagnetic signal in the propagated beam has a wavelength $\lambda$, and wherein the first and second plates a separated by a distance that is greater than $\lambda/2$ and less than $\lambda$.

18. The scanning antenna of claim 1, wherein the transmission line is supported by at least a pair of support elements having a dielectric permittivity that is approximately equal to 1.

19. The scanning antenna of claim 18, wherein the first and second plates are fixed to first and second opposed sides, respectively, of the support elements.

20. The scanning antenna of claim 1, further comprising a refractive lens arranged distally from the distal ends of the first and second plates.

21. The scanning antenna of claim 1, further comprising a reflective surface arranged distally from the distal ends of the first and second plates.

22. The scanning antenna of claim 1, wherein the electromagnetic signal has a propagation wavelength $\lambda$, and wherein the proximal end of each of the plates is separated from the antenna element by a gap that is less than $\lambda/2$ in width.

23. A waveguide assembly for a scanning antenna for the transmission and/or reception of an electromagnetic signal having a propagation wavelength $\lambda$, the antenna including an antenna element with an evanescent coupling portion the waveguide assembly comprising:

a transmission line through which an electromagnetic signal is transmitted, wherein the transmission line defines an axis, and wherein the transmission line is located adjacent the evanescent coupling portion of the antenna element so as to permit evanescent coupling of an electromagnetic signal between the transmission line and the antenna element; and first and second substantially parallel conductive waveguide plates disposed on opposite sides of the transmission line, each of the plates defining a plane that is substantially parallel to the axis defined by the transmission line, each of the plates having a proximal end spaced from the antenna element by a gap of less than $\lambda/2$ in width, and a distal end remote from the antenna element, the plates being separated by a distance that is less than $\lambda$ and greater than $\lambda/2$:

whereby the electromagnetic signal coupled between the transmission line and the antenna element propagates as a beam that is substantially confined to a space defined between the first and second plates, whereby the beam is in a plane that is substantially parallel to the planes defined by the first and second plates.

24. The waveguide assembly of claim 23, wherein the electric field component of the beam is polarized in a plane parallel to the planes defined by the plates.

25. The waveguide assembly of claim 23, wherein the distal end of each of the plates is angled outwardly from the plane of the associated plate, whereby the distal ends of the plates form a horn element.

26. The waveguide assembly of claim 23, further comprising a leaky planar waveguide element disposed between the plates and extending distally from the distal ends of the plates.

27. The waveguide assembly of claim 26, wherein the leaky planar waveguide element comprises a dielectric waveguide element.

28. The waveguide assembly of claim 27, wherein the dielectric waveguide element has a distal end forming a linear edge that is substantially parallel with the axis defined by the transmission line.

29. The waveguide assembly of claim 27, wherein the dielectric waveguide element includes a surface configured as a fixed diffraction grating.

30. The waveguide assembly of claim 26, wherein the leaky waveguide element comprises a conductive metal waveguide element that defines a fixed diffraction grating.

31. The waveguide assembly of claim 26, wherein the leaky planar waveguide element defines a fixed diffraction grating.

32. The waveguide assembly of claim 31, wherein the leaky planar waveguide element comprises a dielectric waveguide element.

33. The waveguide assembly of claim 31, wherein the leaky planar waveguide element comprises a conductive metal waveguide element.

34. The waveguide assembly of claim 23, wherein the transmission line is supported by at least a pair of support elements having a dielectric permittivity that is approximately equal to 1.

35. The waveguide assembly of claim 34, wherein the first and second plates are fixed to first and second opposed sides, respectively, of the support elements.

36. The waveguide assembly of claim 23, further comprising a refractive lens arranged distally from the distal ends of the first and second plates.

37. The waveguide assembly of claim 23, further comprising a reflective surface arranged distally from the distal ends of the first and second plates.

* * * * *